US006227391B1

(12) United States Patent
King

(10) Patent No.: US 6,227,391 B1
(45) Date of Patent: May 8, 2001

(54) CLOSURE ASSEMBLY FOR PRESSURIZED CONTAINERS

(75) Inventor: Roger Milner King, Latimer (GB)

(73) Assignee: Beeson and Sons Limited, Rickmansworth (GB)

( * ) Notice: Subject to any disclaimer, the term of this patent is extended or adjusted under 35 U.S.C. 154(b) by 0 days.

(21) Appl. No.: 09/529,317

(22) PCT Filed: Oct. 9, 1998

(86) PCT No.: PCT/GB98/03040

§ 371 Date: Jun. 12, 2000

§ 102(e) Date: Jun. 12, 2000

(87) PCT Pub. No.: WO99/19228

PCT Pub. Date: Apr. 22, 1999

(30) Foreign Application Priority Data

Oct. 10, 1997 (GB) ..... 9721568

(51) Int. Cl.[7] ..... B65D 41/36; B65D 51/16
(52) U.S. Cl. ..... 215/307; 215/330; 215/332
(58) Field of Search ..... 215/307, 329, 215/330, 331, 332, 222, 218; 220/298, 293, 296, 374, 366.1

(56) References Cited

U.S. PATENT DOCUMENTS

| | | |
|---|---|---|
| D. 327,644 | 7/1992 | Offley et al. . |
| D. 329,980 | 10/1992 | Powell et al. . |
| D. 364,808 | 12/1995 | King . |
| D. 381,907 | 8/1997 | King . |
| D. 392,187 | 3/1998 | King . |
| 2,600,703 | 6/1952 | Strom . |
| 2,623,657 | 12/1952 | De Vries . |
| 4,007,848 | 2/1977 | Snyder . |

(List continued on next page.)

FOREIGN PATENT DOCUMENTS

| | | |
|---|---|---|
| 0 227 203 | 7/1987 | (EP) . |
| 261370 | 4/1927 | (GB) . |
| 2 257 693 | 1/1993 | (GB) . |
| 2 260 534 | 4/1993 | (GB) . |
| 2 261 656 | 5/1993 | (GB) . |

(List continued on next page.)

OTHER PUBLICATIONS

Pending Beeson & Sons U.S. application No. 29/127,643, King, filed Aug. 9, 2000.

*Primary Examiner*—Nathan J. Newhouse
(74) *Attorney, Agent, or Firm*—Brinks Hofer Gilson & Lione

(57) ABSTRACT

A container closure assembly that includes a container neck having an opening and a closure for the container neck, wherein the closure has a base portion and a skirt portion. A first screw thread on one of the container neck and the closure, the first screw thread comprising one or more first thread segments and a second screw thread on the other of the container neck and the closure, the second screw thread having a plurality of second thread segments, each of the second thread segment including upper and lower thread surfaces. A seal that forms a seal between the container neck and closure when the closure is screwed down on the container neck. Mutually engageable elements on the container neck and closure to block or restrict rotation of the closure in an unscrewing direction beyond an intermediate position when the closure is under an axial pressure in a direction emerging from the container neck. The container neck and closure are constructed and arranged to provide a vent for venting gas from the container neck at least when the closure is in the intermediate position and the vent includes a recess in the other of the container neck and closure. The recess being located between and circumferentially overlapping two of the plurality of second thread segments to increase the cross-sectional area of the vent between the second thread segments.

41 Claims, 2 Drawing Sheets

U.S. PATENT DOCUMENTS

| | | | |
|---|---|---|---|
| 4,032,028 | * | 6/1977 | Reiss et al. . |
| 4,084,717 | | 4/1978 | King . |
| 4,275,817 | | 6/1981 | Patton . |
| 4,387,817 | | 6/1983 | Wiles et al. . |
| 4,392,055 | | 7/1983 | Whitney . |
| 4,444,327 | | 4/1984 | Hedgewick . |
| 4,456,137 | | 6/1984 | Lyman . |
| 4,553,678 | | 11/1985 | Thorsbakken . |
| 4,669,624 | | 6/1987 | Wiles et al. . |
| 4,799,597 | | 1/1989 | Mayes et al. . |
| 4,936,474 | | 6/1990 | Szczesniak et al. . |
| 5,135,124 | * | 8/1992 | Wobser . |
| 5,213,225 | | 5/1993 | King et al. . |
| 5,219,084 | | 6/1993 | King . |
| 5,320,233 | | 6/1994 | Welch . |
| 5,411,157 | | 5/1995 | King et al. . |
| 5,443,175 | | 8/1995 | Kelly et al. . |
| 5,454,476 | | 10/1995 | King et al. . |
| 5,462,186 | | 10/1995 | Ladina et al. . |
| 5,533,633 | * | 7/1996 | King . |
| 5,588,545 | | 12/1996 | King . |
| 5,590,799 | | 1/1997 | King . |
| 5,611,443 | | 3/1997 | King . |
| 5,638,969 | | 6/1997 | King . |
| 5,667,088 | | 9/1997 | King et al. . |
| 5,676,268 | | 10/1997 | King . |
| 5,743,419 | | 4/1998 | King . |
| 5,746,337 | * | 5/1998 | Haist . |
| 5,769,254 | | 6/1998 | King et al. . |
| 5,788,101 | | 8/1998 | King . |
| 5,794,806 | | 8/1998 | Harris et al. . |
| 5,819,965 | | 10/1998 | King et al. . |
| 5,836,465 | | 11/1998 | King . |
| 6,015,054 | | 1/2000 | King et al. . |

FOREIGN PATENT DOCUMENTS

| | | |
|---|---|---|
| 2 262 280 | 6/1993 | (GB) . |
| 2 264 108 | 8/1993 | (GB) . |
| 2 267 076 | 11/1993 | (GB) . |
| 2 267 082 | 11/1993 | (GB) . |
| 2 267 484 | 12/1993 | (GB) . |
| 2 275 048 | 8/1994 | (GB) . |
| 2 276 615 | 10/1994 | (GB) . |
| 2 288 390 | 10/1995 | (GB) . |
| WO 91/07331 | 5/1991 | (WO) . |
| WO 91/18799 | 12/1991 | (WO) . |
| WO 93/01098 | 1/1993 | (WO) . |
| WO 94/11267 | 5/1994 | (WO) . |
| WO 95/05322 | 2/1995 | (WO) . |
| WO 97/21602 | 6/1997 | (WO) . |

* cited by examiner

CLOSURE ASSEMBLY FOR PRESSURIZED CONTAINERS

Applicant claims, under 35 U.S C. § 119, the benefit of priority of the filing date of Oct. 10, 1997 of a United Kingdom patent application, copy attached, Serial Number 9721568.5, filed on the aforementioned date, the entire contents of which is incorporated herein by reference.

BACKGROUND OF THE INVENTION

1. Field of the Invention

The present invention relates to a container neck and closure assembly for use on pressurized containers such as carbonated beverage containers.

2. Description Of the Related Art

Current commercially mass-produced carbonated beverage containers use threads on the container and closure of the continuous, helical type. The threads comprise a single, substantially continuous thread portion on the container neck with a low thread pitch angle, typically less than 5°. The low pitch angle is needed in order to ensure that the closure does not unscrew spontaneously under pressure from inside the container. The low pitch angle also provides the necessary leverage to achieve a gas-tight compressive seal between the closure and the container neck when the closure is tightened onto the container neck. The low pitch of the helical threads also means that the closure typically needs to be rotated through more than 360° to disengage it completely from the container neck. Whilst this can be laborious, especially for elderly or child users, it also permits some gas venting to take place while the closure is being unscrewed, and thereby reduces the risk that the closure will blow off uncontrollably once unscrewing of the closure from the container neck has commenced. This gas venting is usually assisted by the provision of axial gas venting notches extending longitudinally through the helical threads.

Drawbacks of these low pitch helical threads include the laborious rotation required to remove and resecure the closure on the neck, excessive use of molding material to form the long helical threads, and unreliable separation of tamper-evident rings from the closure skirt due to the low pitch angle of the threads.

U.S. Pat. No. 5,135,124 describes a container closure assembly for a carbonated beverage container that incorporates a safety feature to prevent the closure blowing of off uncontrollably (missiling) as it is unscrewed from a container under high pressure. The closure assembly is provided with a complex double-bayonet thread arrangement to provide for gas venting at an intermediate position of the closure on the container neck. The bayonet thread arrangement can be difficult for infirm or very young users to assemble and disassemble successfully, since these operations involve sequential steps of pressing down and rotating the closure. Moreover, to achieve a pressure-tight seal, a strong axial sealing force must be applied by the user in the initial pressing-down step of securing the closure on the container neck. Furthermore, the bayonet-type threads are inherently less suitable for reliable operation of a tamper-evident ring that is frangibly attached to the closure skirt, but that is retained on the container neck after the assembly is opened for the first time.

The present applicant has described an improved pressure safety cap for carbonated beverage containers in International Patent Publication WO95/05322. This application describes container closure assemblies having substantially continuous threads defining a substantially continuous helical thread path, although the pitch of the helix can vary. The closure can be moved from a fully disengaged to a fully secured position on the container neck by rotation through 360° or less. The threads on the neck or the closure are provided with mutually engageable elements to block or restrict rotation of the closure in an unscrewing direction beyond an intermediate position when the closure is under an axial pressure in a direction emerging from the container neck, the neck and closure being constructed and arranged to provide a vent for venting gas from the container neck at least when the closure is in the intermediate position. This pressure safety feature prevents the closure from blowing off uncontrollably once unscrewing of the closure from the container neck has started. It thus allows the use of shorter, more steeply pitched or multiple-start threads in the container and closure assembly, thereby rendering the assembly much more elderly- and child-friendly without sacrificing pressure safety.

WO97/21602 describes an improved version of the assemblies of WO95/05322 in which the thread on the container neck has a lower surface having a variable pitch, such that the pitch of thread is lower in a region near the bottom of the thread. This reduces the tendency of the closure to blow off when the container is sealed and pressurized. A further region of low pitch may be provided on the neck thread adjacent to the intermediate position where gas venting takes place. This reduces the tendency of the closure to override the blocking means at the intermediate position while gas venting is taking place.

GB-A-2288390 describes container closure assemblies for beverage containers. The closure cap screws onto the container neck in less that half a turn, with pins carried on the cap engaging between screw threads provided on the container neck. The threads are variably pitched to give a decreased final angle of pitch in order to reduce the likelihood that pressure exerted on the cap will cause the cap to back off the container neck. Slots may be provided on the underside of the threads to block unscrewing of the cap beyond an intermediate position until venting of pressure from inside the container has taken place.

SUMMARY OF THE INVENTION

It is an and advantage of the present invention to provide an improved pressure venting arrangement for a pressure safety container and closure assembly that can permit faster venting of excess pressure from inside the container, and thereby enable quicker removal of the closure from the container neck.

One aspect of the present invention regards a container closure assembly including:

- a container neck having an opening;
- a closure for the neck, the closure having a base portion and a skirt portion;
- a first screw thread on one of the neck and the closure, the first screw thread having one or more first thread segments; and
- a second screw thread on the other of the neck and the closure, the second screw thread comprising a plurality of second thread segments, each second thread segment having upper and lower thread surfaces, and regions of the second thread segments being circumferentially overlapping,
- a seal between the neck and the closure when the closure is screwed down onto the neck;
- mutually engageable elements on the neck and closure to block or restrict rotation of the closure in an unscrewing direction beyond an intermediate position when the closure is under an axial pressure in a direction emerging from the container neck;

wherein the neck and closure are constructed and arranged to provide a vent for venting gas from the container neck at least when the closure is in the intermediate position, and wherein the vent includes a recess in the other of the neck and closure, the recess being located between and circumferentially overlapping two of the plurality of second thread segments to increase the cross-sectional area of the vent between the second thread segments.

The second thread segments are not bayonet-type thread segments. The second thread segments extend around the container neck or closure skirt a sufficient distance so that a top portion of one thread segment is proximate to a bottom portion of another thread segment, and preferably overlaps the other thread segment for a finite angular distance around the neck or closure skirt. That is to say, preferably adjacent second thread segments are circumferentially overlapping. A thread gap is defined between the top and bottom portions of the thread segments. One of the first thread segments travels through this thread gap as the closure is screwed onto or off the container neck. It has been found that this thread gap may have a cross-section that is too small for optional gas venting in all circumstances. The present invention overcomes this difficulty by providing a recess in the container neck or closure skirt to increase the cross-section of the thread gap to increase the rate of gas venting through the thread gap.

The increased cross-sectional area of the venting pathway in the circumferentially overlapping regions of the second thread permits faster venting of pressure from inside the container, and thereby reduces the length of time that the closure is blocked at the intermediate position while venting takes place, without any loss of pressure safety.

Preferably, the recess has an elongate groove extending around the container neck or the closure skirt between the second thread segments in the overlapping regions. Preferably, the elongate groove extends substantially parallel to the second thread segments. Preferably, the second thread segments are on the container neck, where they project outwardly from a substantially cylindrical neck surface. In that case, the recess preferably has an elongate groove in the container neck. Preferably, the longitudinal cross-sectional area of the recess is from 5% to 50% of the longitudinal cross-sectional area of the second thread segments adjacent to the recess.

Preferably, the first and second screw threads are constructed and arranged to permit axial displacement of the closure relative to the neck at least when the closure is at the intermediate position, and preferably the engageable elements are adapted to engage each other when the closure is axially displaced in a direction emerging from the neck, for example by axial pressure from inside the pressurized container. More preferably, the mutually engageable elements are constructed and arranged not to mutually engage each other when the closure is axially displaced in a direction inwardly towards the neck at the intermediate position, for example when the closure is being screwed down onto the container neck.

Preferably, the mutually engageable elements have a step or recess formed in the lower surface of one of the second screw thread segments to provide a first abutment surface against which a second abutment surface on one of the first screw thread segments abuts to block or restrict rotation of the closure in an unscrewing direction at the intermediate position when the closure is under axial pressure in a direction emerging from the container neck.

More Preferably, the second thread segment has a first thread portion having a first cross section and a second thread portion having a second cross section narrower than the first cross section, whereby a step is provided in the lower thread surface of the second thread segment where the first and second thread portions meet, and the first abutment surface being provided by the step. The relatively broad first cross section is preferably adjacent to the circumferentially overlapping region of the second thread segments, resulting in a relatively narrow thread gap in that region, hence the desirability of the recess provided by the present invention to increase the cross-section of the thread gap. More preferably, the upper surface of the second thread segment opposite the lower surface of the second thread segment is substantially smooth and continuous where the first and second thread portions meet.

Preferably, at least one of the first and second threads has four thread starts. This minimizes the amount of rotation of the closure on the container neck that is required to achieve initial engagement of the threads, thereby making the assembly more elderly- and child-friendly.

Preferably, the closure can be moved from a fully released to a fully engaged position on the neck by a single smooth rotation through 360° or less, more preferably 180° or less, and most preferably about 90° or less.

Preferably, the first thread segments follow a substantially continuous, preferably substantially helical thread path for the whole of the rotation as the closure is screwed onto the container neck, although the pitch of the helix may vary. The continuous thread path renders the assembly especially easy to close by the elderly and infirm, or by children. In contrast, bayonet-type threads of the kind described in U.S. Pat. No. 5,135,124 require a relatively complex, stepped manipulation to secure the closure onto the container neck, with the result that the closure is often inadequately secured on the container neck. Furthermore, it is extremely difficult to devise a tamper-evident ring for the closure that separates reliably and easily upon opening of a bayonet-type closure assembly. Finally, a continuous thread is easier for physically weak people to screw down against pressure from inside the container than a bayonet thread.

A seal between the neck and the closure is formed if screwed down on the neck is preferably a compressible sealing wad inside the base portion of the closure for abutting against a lip of the container neck. Preferably, the sealing wad is formed from a compressible elastomer. A circumferential sealing rib may be provided on the lip of the container neck, or inside the base of the closure underneath the sealing wad, in order to optimise compression of the elastomer to achieve a pressure-tight seal.

Preferably, the assembly further has complementary locking devices on the container neck and the closure that prevent unscrewing of the closure from the fully engaged and sealing position on the container neck until a predetermined minimum opening torque is applied. More preferably, the locking devices comprise a longitudinal locking rib on one of the container neck or on the skirt portion of the closure, and a complementary locking ramp on the other of the container neck or the skirt portion of the closure, wherein the locking rib abuts against a retaining edge of the locking ramp when the closure is fully engaged on the container neck. In alternative preferred embodiments, a locking recess such as a longitudinal groove may be provided in one or more of the first or second thread segments, and a longitudinal locking rib is provided on the other of the container neck or on the skirt portion of the closure, whereby the locking rib is received in the recess in the thread segments at the fully engaged and sealing position of the closure on the container neck. Locking devices of this kind are described in detail in WO91/18799 and WO95/05322, the entire disclosures of which are expressly incorporated herein by reference.

The complementary locking devices provide a number of important advantages. Firstly, they prevent accidental backing off of the closure from the fully engaged and sealing position on the container neck due to pressure from inside the container. This also permits the use of more steeply pitched threads on the container neck and the closure. Furthermore, the locking devices provide a positive "click" when the fully engaged and sealing position of the closure on the container neck is reached, thereby giving the user a positive indication of that position. This helps to ensure that exactly the right degree of compression is applied between the container and closure to achieve an effective pressure-tight seal.

Preferably, the container closure assemblies according to the present invention further have a first stop on one of the container neck and the closure for abutment against a complementary second stop on the other of the container neck and the closure to block over-tightening of the closure beyond the predetermined fully engaged and sealing position on the container neck. More preferably, the first stop has a longitudinal shoulder adjacent to the bottom of the second thread segment, and the second stop is an end of the first thread segment. In other preferred embodiments, the first stop may project from the container neck or the closure skirt adjacent to the locking ramp as described above, and the second stop is the longitudinal locking rib referred to above, which snaps into a recess between the first stop and the locking ramp at the said fully engaged and sealing position. Suitable stop devices are described in WO91/18799.

The provision of the stop devices to prevent over-tightening of the closure on the container neck is useful to prevent damage to the threads by over-tightening. It also ensures that precisely the right degree of compression of the sealing wad is achieved at the fully engaged and sealing position so that an effective pressure seal is formed. Over-compression of elastomeric sealing wads can result in a loss of resilience and cracking of the sealing wads, resulting in loss of pressure-tightness.

Preferably, the first and second threads on the container neck and closure are variable pitch threads, preferably as described in WO97/21602, the entire contents of which are incorporated herein by reference. Preferably, the pitch of the lower thread surface of the second thread segments is relatively lower in a first region and relatively higher in a second region displaced from the first region in an unscrewing direction. The pitch of the lower thread surface in the first region is preferably substantially constant. Preferably, the first region extends for 20–40° about the circumference of the container neck or the closure skirt. Preferably, the pitch of the lower thread surface in the first region is in the range of −5° to 10°, more preferably 1° to 7°.

Preferably, the second region is adjacent to the first region of the lower thread surface. Preferably, the pitch of the lower thread surface in the second region is substantially constant, and the second region preferably extends for 15–35° about the circumference of the container neck or the closure skirt. Preferably, the pitch of the lower thread surface in the second region is in the range of 15°to 350°.

The use of a variable pitch thread renders it easier to combine fast-turn threads having a steep average pitch that are elderly-and child-friendly with pressure safety. A problem that could arise with fast-turn threads is that they are steeply pitched, which results in a tendency to back off from the fully secured position on the container neck when the container is pressurized. This problem can be overcome by using bayonet-type threads, but the use of bayonet-type threads results in a number of different problems, as described above. In contrast, the variable pitch threads solve the problem of backing off of the closure under pressure, whilst retaining all of the advantages of continuous, fast-turn threads.

Preferably, the lower thread surface further has a third region adjacent to the second region, wherein the third region has a relatively low pitch. Preferably, the third region has a relatively constant pitch, preferably in the range 1 to 12°. The third region is located to abut against the first thread segments of the other of the container neck and the closure when the cap is blocked at the intermediate gas venting position. The relatively low pitch of the third region reduces the tendency of the cap to override the blocking device at high gas venting pressures.

Preferably, the first and/or the second thread segments are interrupted by axial gas venting channels, similar to those on existing carbonated beverage shallow-pitch threads. The axial gas venting channels assist the venting of pressure from inside the container as the closure is unscrewed. However, the molding of axial gas venting channels on the container neck by blow molding can be difficult using a conventional two-part mold.

Therefore, more preferably, the container closure assembly according to the present invention further includes a transverse gas venting channel extending through one or more of the first and/or second thread segments. The term "transverse" implies that the gas venting channel extends substantially circumferentially around the container neck or the closure skirt. Preferably, two transverse gas venting channels extend through the thread segments on opposite sides of the container neck and across the blow-molding seam of the container neck.

Preferably, the transverse gas venting channel is tapered, so that the channel is narrower on the lower side of the thread segment than on the upper side of the thread segment. This is to maximize the area of contact between the first and second thread segments when the closure is under pressure from inside the container.

Specific embodiments of the container closure assemblies according to the present invention will now be described further, by way of example, with reference to the accompanying drawings, in which:

DESCRIPTION OF THE PREFERRED EMBODIMENT(S)

Figure 2:
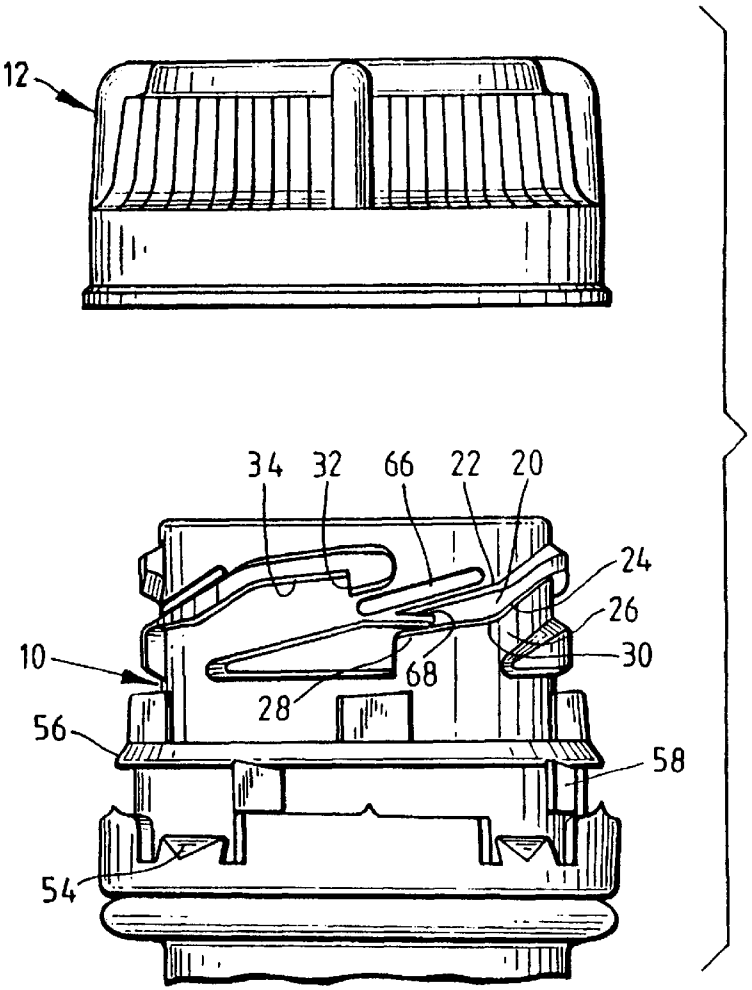
FIG. 2 shows a side elevation view of the container closure assembly of FIG. 1 after removal of the closure.
Figure 1:
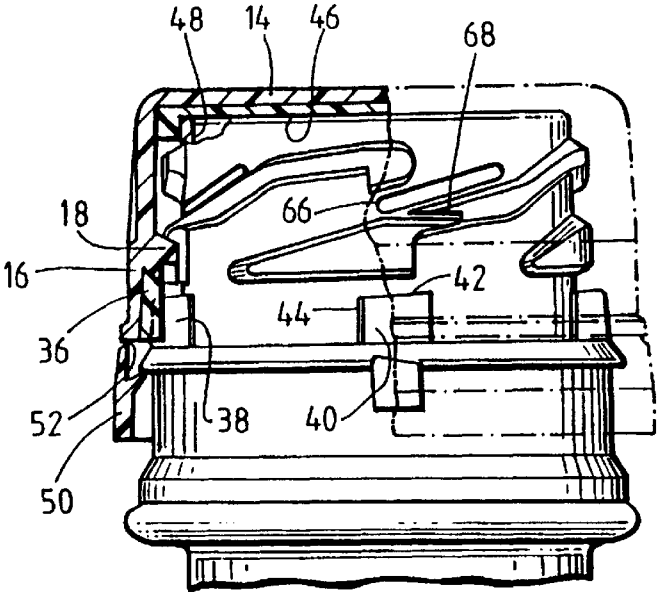
FIG.1 shows a side elevation view of a container closure assembly according to the present invention with the closure in the fully engaged position on the container neck. The closure is shown partly cut away and partly in cross section.

Referring to FIGS. 1 and 2, this embodiment is a container closure assembly especially adapted for a carbonated beverage container The main features of this assembly resemble those of the assembly described and claimed in our International Patent Publications WO95/05322 and WO97/21602, the entire contents of which are expressly incorporated herein by reference.

The assembly includes a container neck 10 of a container for carbonated beverages, and a closure 12. Both the container neck and the closure are formed from plastics material. The container is preferably formed by injection molding and blow molding of polyethylene terephthalate in the manner conventionally known for carbonated beverage containers. The closure is preferably formed by injection molding of polypropylene. The closure 12 has a base portion 14 and a skirt portion 16.

Figure 3:
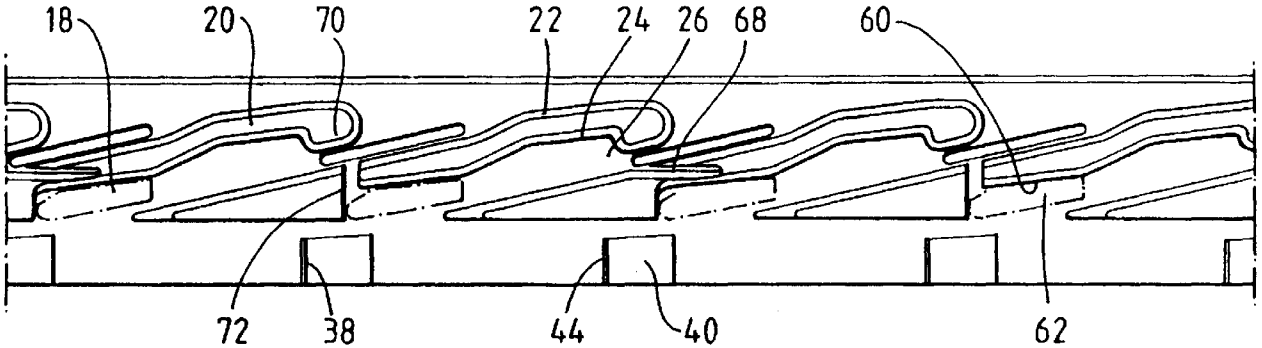
FIG. 3 shows a plane projection of the screw threads of the container neck of FIG. 1, with the screw threads of the closure shown in phantom, and with the closure in the fully engaged position.
Figure 4:
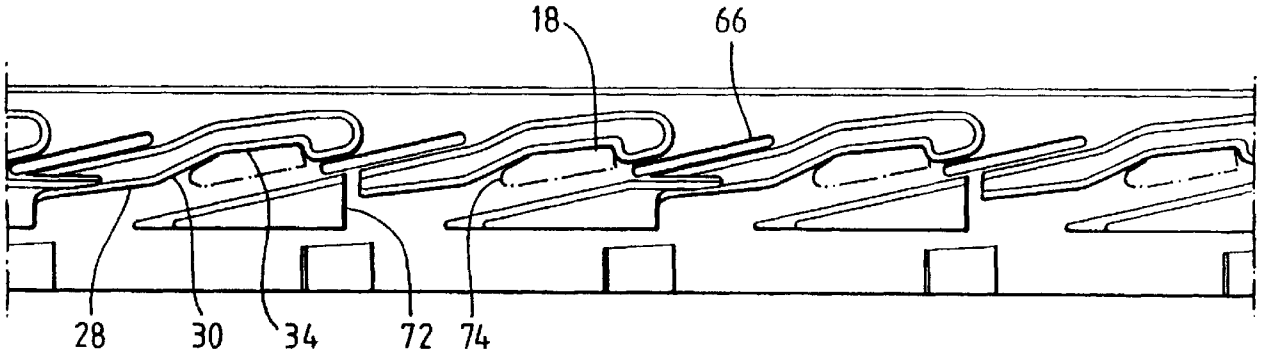
FIG. 4 shows a similar projection to FIG. 3, but with the screw threads of the closure at the intermediate, blocked, gas-venting position.
Figure 5:
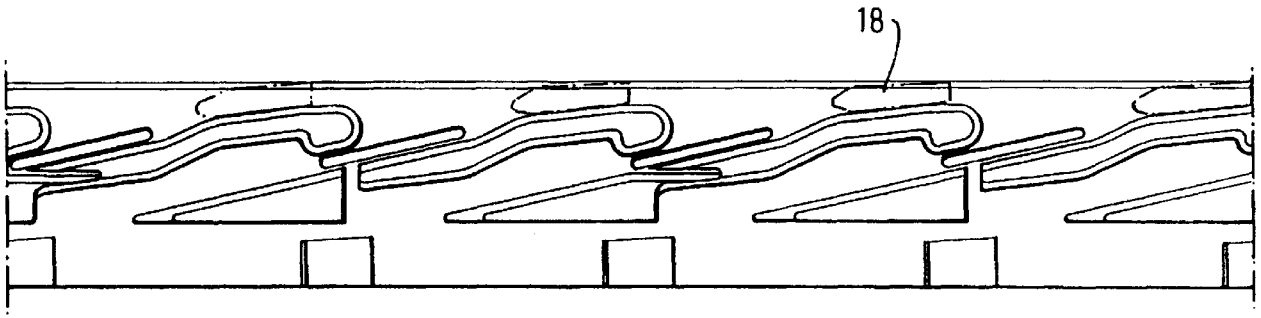
FIG. 5 shows a similar projection to FIGS. 3 and 4, but with the screw threads of the closure in the unblocked screwing/unscrewing position.

On the inside of the skirt portion 16 there is provided a four-start first screw thread made up of four first thread segments 18, as shown in phantom on the thread developments of FIGS. 3–5. The first thread segments 18 are short thread segments having an upper surface 60 with relatively low pitch of about 6° and a lower surface 62 with intermediate pitch of about 13.5°.

The container neck 10 is provided with a second screw thread formed from four second thread segments 20, each of which is a substantially continuous helical thread having an upper thread surface 22 and a lower thread surface 24. The upper and lower second thread surfaces 22, 24 are sloped to give the second thread segment a trapezoidal cross-section. A substantially continuous, approximately helical thread gap 26 is defined between overlapping regions of the said upper and lower surfaces 22, 24 on adjacent second thread segments 20.

It can be seen that the second thread segments 20 are circumferentially overlapping over part of their length. A groove 66 is provided in the container neck 10 between the second thread segments 20 in the overlapping region 26.

It can also be seen that a transverse groove 68 is provided in alternate second thread segments 20, extending from the upper thread surface 22 through to a first region 28 of the lower thread surface 24. The transverse groove is tapered from top to bottom.

An important feature of this assembly is the profiling of the lower surface 24 of the second thread segments 20, which is described in more detail in our International Patent Publication WO97/21602. The lower thread surface 24 includes a first, lower region 28 having a substantially constant pitch of only about 6°. The lower region 28 adjoins an intermediate region 30 having a substantially constant, much higher pitch of about 25°. The average pitch of the thread segment 20 (i.e. the pitch of the straight upper thread surface 22) is 13.5°.

The second thread segments 20 also include a pressure safety feature similar to that described and claimed in our International Patent Publication WO95/05322. Briefly, a step 32 is provided in the lower surface 24 of the second thread segment 20 to abut against an end of the first thread segments 18 and block unscrewing of the closure 12 from the neck 10 when the first thread segments 18 are in abutment with the lower surface 24, i.e. when there is a net force on the closure in an axial direction out of the container neck. A third region 34 of the lower surface 24 of the second thread segments situated adjacent to the step 32 also has a low pitch of about 6°. The step is formed by the junction between a relatively broad top portion 70 of the second thread segment and the relative narrow third region 34 of the second thread segment 20.

The container and closure assembly is also provided with complementary locking elements on the container neck and the closure to block unscrewing of the closure from the fully engaged position on the container neck unless a minimum unscrewing torque is applied. These locking elements comprise four equally radially spaced locking ribs 36 on the inside of the closure skirt 16, and four equally radially spaced retaining ramps 38 on the container neck. The ramps 38 have a radially sloped outer face 40 and a radially projecting retaining edge 44 against which the rib 36 on the closure abuts when the closure is fully engaged on the container neck. The complementary locking elements may be as described in our International Patent Publication WO91/18799, the entire content of which is hereby expressly incorporated by reference.

The container and closure assembly also includes a gas-tight seal between the closure and the container neck. This seal preferably comprises a gas-tight elastomeric sealing wad 46 that is compressed against the lip of the container neck. Optimum sealing is preferably achieved when the elastomeric sealing wad is compressed to between 30% and 70% of its original thickness.

The second thread segments 20 terminate at their lower end in a longitudinal shoulder 72 forming a first stop against which a second end 74 of the first thread segments 18 may abut thereby to block overtightening of the closure on the neck.

The container closure assembly also comprises a tamper-evident safety feature. The safety feature includes a tamper-evident ring 50 that is initially formed integrally with the skirt 16 of the container closure 12 and joined thereto by frangible bridges 52. The tamper-evident ring 50 comprises a plurality of integrally formed, flexible, radially inwardly pointing retaining tabs 54. A circumferential retaining lip 56 is provided on the container neck 10. Ratchet projections 58 are also provided on the container neck below the circumferential retaining lip 56 and radially spaced around the container neck to block rotation of the tamper-evident ring 50 on the container neck 10 in an unscrewing direction. The structure and operation of the tamper-evident ring feature are as described and claimed in our International Patent Publication WO94/11267, the entire contents of which are expressly incorporated herein by reference.

In use, the closure 12 is secured onto the container neck 10 by screwing down in conventional fashion. The closure 12 can be moved from a fully disengaged position to a fully engaged position on the container neck 10 by rotation through about 90°. When the closure is being screwed down, there is normally a net axial force applied by the user on the closure into the container neck, and accordingly the first thread segments 18 abut against and ride along the upper surface 22 of the second thread segments 20 on the container neck. It can thus be seen that the first thread segments follow a substantially continuous path along a variable pitch helix. The first and second threads are free-running, which is to say that there is substantially no frictional torque between the thread segments until the fully engaged position is neared. These features of a 90° closure rotation, substantially continuous thread path and free-running threads all make the closure extremely easy to secure on the container neck, especially for elderly or arthritic persons, or children.

As the closure nears the fully engaged position on the container neck 10, several things happen. Firstly, the tamper-evident ring 50 starts to ride over the retaining lip 56 on the container neck. The retaining tabs 54 on the tamper-evident ring 50 flex radially outwardly to enable the tamper-evident ring to pass over the retaining lip 56 without excessive radial stress on the frangible bridges 52. The flexible retaining tabs 54 subsequently ride over the radial ratchet projections 58 on the container neck in similar fashion.

Secondly, the locking ribs 36 on the closure skirt 16 ride up the outer ramped surface 40 of the retaining ramps 38 on the container neck. The gentle slope of the ramped surfaces 40, together with the resilience of the closure skirt 16, mean that relatively little additional torque is required to cause the locking ribs 36 to ride up the ramped surfaces 40.

Thirdly, the initial abutment between the sealing wad 46 in the container closure base and the sealing rib 48 on the container neck results in a net axial force on the closure in a direction out of the container neck. This pushes the thread segments 18 on the closure skirt out of abutment with the upper surface 22 of the second thread segments 20 and into abutment with the lower thread surfaces 24 of the second thread segments 20. More specifically, it brings the first thread segments 18 into abutment with the lower region 28 of the lower thread surfaces 24. Continued rotation of the closure cap in a screwing-down direction causes the first thread segments 18 to travel along the lower region 28 until the final, fully engaged position shown in FIG. 3 is reached. The low pitch of the lower surface 28 devices that this further rotation applies powerful leverage (camming) to compress the sealing wad 46 against the sealing rib 48 in order to achieve an effective gas-tight seal.

When the fully engaged position of the closure 12 on the container neck 10 is reduced, the locking ribs 36 click over the top of the respective ramped surfaces 40 and into abutment with the steep retaining surfaces of the ratchet 30 ramps 38. At the same position, the second ends 74 of the first thread segments 18 may come into abutment with the stop shoulders 72 at the bottom of the second thread segments, thereby blocking further tightening of the closure than could damage the threads and/or over-compress the sealing wad.

When the closure 12 is in the fully engaged position on the container neck 10, the upper surfaces 60 of the first thread segments 18 abut against the lower region 28 of the lower thread surfaces 24 of the second thread segment 20 on the container neck, as shown in FIG. 3. The upper surface of the first thread segments has a low pitch to match that of the lower region 28, so as to maximize the contact area between the thread segments in this region 28, and thereby distribute the axial force exerted by the closure as evenly as possible around the container neck. Because of the low pitch in the region 28, relatively little of the axial force emerging from the container neck due to pressure inside the container is cammed into unscrewing rotational force by the abutment between the thread surfaces in this position. This greatly reduces the tendency of the closure to unscrew spontaneously under pressure. Spontaneous unscrewing is also prevented by the abutment between the locking ribs 36 and the retaining edge 44 on the locking ramps 38. An important advantage of the assembly is that the reduced tendency to unscrew spontaneously due to the low pitch of the lower thread surfaces in the lower regions 28 devices that the minimum opening torque of the locking elements 36, 38 can be reduced without risk of the closure blowing off spontaneously. This makes the closure easier to remove by elderly or arthritic people, or by children, without reducing the pressure safety of the closure.

In use, the closure is removed from the container neck by simple unscrewing. An initial, minimum unscrewing torque is required to overcome the resistance of the locking elements 36, 38. Once this resistance has been overcome, essentially no torque needs to be applied by the user to unscrew the closure. The internal pressure inside the container exerts an axial force on the closure in a direction emerging from the mouth of the container, as a result of which the first thread segments 18 ride along the lower surface 28 of the second thread segments 20 as the closure is unscrewed. The first thread segments initially ride along the lower region 28, and then along the steeply pitched intermediate region 30 of the lower surface of the second thread segments 20. The first thread segments 18 then come into abutment with the step 32 of the second thread segments 20, as shown in FIG. 4. In this position, further unscrewing of the closure is blocked while gas venting takes place along the thread paths 26. It should also be noted that, in this intermediate gas venting position, the first thread segments 18 abut primarily against the third region 34 of the lower surface of the second thread segments 20. The low pitch of this region 34 results in relatively little of the axial force on the closure being cammed into unscrewing rotational torque, thereby reducing the tendency of the closure to override the pressure safety feature and blow off.

It will be appreciated that the groove 66 in the container neck enables faster gas venting along a helical gas venting path 26 between the overlapping regions of the second thread segments 20. In addition, the transverse vents 68 through the second thread segments 20 provide further gas venting pathways at the intermediate position of the closure on the container neck.

Once gas venting from inside the container neck is complete so that there is no longer axial upward force on the closure, the closure can drop down so as to bring the thread segments 18 into abutment with the upper surfaces 22 of the second thread segments 20. In this position, unscrewing can be continued to disengage the closure completely from the container neck as shown in FIG. 5.

The above embodiment has been described by way of example only. Many other embodiments of the present invention falling within the scope of the accompanying claims will be apparent to the skilled reader.

What is claimed is:

1. A container closure assembly comprising;

a container neck having an opening;

a closure for said container neck, wherein said closure comprises a base portion and a skirt portion;

a first screw thread on one of said container neck and said closure, said first screw thread comprising one or more first thread segments; and a second screw thread on the other of said container neck and said closure, said second screw thread comprising a plurality of second thread segments, each of said second thread segment comprising upper and lower thread surfaces;

a seal that forms a seal between said container neck and closure when said closure is screwed down on said container neck;

mutually engageable elements on said container neck and closure to block or restrict rotation of said closure in an unscrewing direction beyond an intermediate position when said closure is under an axial pressure in a direction emerging from said container neck;

wherein said container neck and closure are constructed and arranged to provide a vent for venting gas from said container neck at least when said closure is in said intermediate position; and wherein said vent includes a recess in the said other of said container neck and closure, said recess being located between and circumferentially overlapping two of said plurality of second thread segments to increase the cross-sectional area of said vent between said second thread segments.

2. A container closure assembly according to claim 1, wherein said recess comprises an elongate groove extending around one of said container neck and said closure skirt between said second thread segments.

3. A container closure assembly according to claim 1, wherein said first and second screw threads are constructed and arranged to permit axial displacement of said closure relative to said container neck at least when said closure is at said intermediate position, and wherein said engageable elements engage each other when said closure is axially displaced in a direction emerging from said container neck.

4. A container closure assembly according to claim 2, wherein said first and second screw threads are constructed and arranged to permit axial displacement of said closure relative to said container neck at least when said closure is at said intermediate position, and wherein said engageable elements engage each other when said closure is axially displaced in a direction emerging from said container neck.

5. A container closure assembly according to claim 3, wherein said mutually engageable elements are constructed and arranged not to mutually engage each other when said closure is axially displaced in a direction inwardly towards said container neck at said intermediate position.

6. A container closure assembly according to claim 4, wherein said mutually engageable elements are constructed and arranged not to mutually engage each other when said closure is axially displaced in a direction inwardly towards said container neck at said intermediate position.

7. A container closure assembly according to claim 1, wherein said mutually engageable elements comprise a step or recess formed in a lower surface of one of said second screw thread segments to provide a first abutment surface against which a second abutment surface on one of said first screw segments abuts to block or restrict rotation of said closure in an unscrewing direction at said intermediate position when said closure is under axial pressure in a direction emerging from said container neck.

8. A container closure assembly according to claim 7, wherein complementary steps or recesses for mutual abutment are provided on each of said first and second screw thread segments.

9. A container closure assembly according to claim 7, wherein one of said second thread segments comprises a first thread portion having a first cross section and a second thread portion having a second cross section narrower than said first cross section, whereby a step is provided in a lower thread surface of said one of said second thread segments where said first and second thread portions meet, said first abutment surface being provided by said step of said lower thread surface of said one of said thread segments.

10. A container closure assembly according to claim 8, wherein one of said second thread segments comprises a first thread portion having a first cross section and a second thread portion having a second cross section narrower than said first cross section, whereby a step is provided in a lower thread surface of said one of said second thread segments where said first and second thread portions meet, said first abutment surface being provided by said step of said lower thread surface.

11. A container closure assembly according to claim 9, wherein said upper surface of said one of said second thread segments that is opposite said lower surface of said one of said second thread segments is substantially smooth and continuous where said first and second thread portions of said one of said second thread segments meet.

12. A container closure assembly according to claim 10, wherein said upper surface of said one of said second thread segments that is opposite said lower surface of said one of said second thread segments is substantially smooth and continuous where said first and second thread portions of said one of said second thread segments meet.

13. A container closure assembly according to claim 1, wherein at least one of said first and second screw threads has four thread starts.

14. A container closure assembly according to claim 1, wherein said closure can be moved from a fully released to a fully engaged position on said container neck by a single smooth rotation through an angle that is in the range of 360° or less.

15. A container closure assembly according to claim 14, wherein said closure can be moved from a fully released to a fully closed position on said container neck by a single smooth rotation through an angle that is in the range of 180° or less.

16. A container closure assembly according to claim 15, wherein said closure can be moved from a fully released to a fully closed position on said container neck by a single smooth rotation through an angle that is in the range of about 90° or less.

17. A container closure assembly according to claim 1, wherein said seal comprises a compressible sealing wad inside said base portion of said closure for abutting against a lip of said container neck.

18. A container closure assembly according to claim 1, further comprising complementary locking device on said container neck and said closure that prevents unscrewing of said closure from the fully engaged position on said container neck until a predetermined minimum opening torque is applied.

19. A container closure assembly according to claim 18, wherein said locking device comprise a longitudinal locking rib on one of said container neck and said skirt portion of said closure, and a complementary locking ramp on the other of said container neck and said skirt portion of said closure, said locking rib abutting against a retaining edge of said locking ramp when said closure is fully engage on said container neck.

20. A container closure assembly according to claim 1, further comprising a projecting first stop on one of said container neck and said closure for abutment against a complementary second stop on the other of said container neck and said closure to block over-tightening of the closure beyond a predetermined angular sealing position on said container neck.

21. A container closure assembly according to claim 20, wherein said first stop comprises a longitudinal shoulder adjacent to a bottom of a second thread segment, and said first stop is an end of a first thread segment.

22. A container closure assembly according to claim 1, wherein the pitch of said lower thread surfaces of said second thread segments is relatively lower in a first region and relatively higher in a second region displaced from the first region in an unscrewing direction.

23. A container closure assembly according to claim 21, wherein the pitch of said lower thread surfaces in said first region is substantially constant.

24. A container closure assembly according to claim 22, wherein said first region extends for 20–40° about a circumference of one of said container neck and said closure skirt.

25. A container closure assembly according to claim 23, wherein said first region extends for 20–40° about a circumference of one of said container neck and said closure skirt.

26. A container closure assembly according to claim 21, wherein said pitch of said lower thread surfaces in said first region is in the range −5° to 10°.

27. A container closure assembly according to claim 22, wherein said pitch of said lower thread surfaces in said first region is in the range −5° to 10°.

28. A container closure assembly according to claim 23, wherein said pitch of said lower thread surfaces in said first region is in the range −5° to 10°.

29. A container closure assembly according to claim 24, wherein said pitch of said lower thread surfaces in said first region is in the range −5° to 10°.

30. A container closure assembly according to claim 25, wherein said pitch of said lower thread surfaces in said first region is in the range −5° to 10°.

31. A container closure assembly according to claim 26, wherein said pitch of said lower thread surfaces in said first region is in the range 1° to 7°.

32. A container closure assembly according to claim 27, wherein said pitch of said lower thread surfaces in said first region is in the range 1° to 7°.

33. A container closure assembly according to claim 28, wherein said pitch of said lower thread surfaces in said first region is in the range 1° to 7°.

34. A container closure assembly according to claim 29, wherein said pitch of said lower thread surfaces in said first region is in the range 1° to 7°.

35. A container closure assembly according to claim 30, wherein said pitch of said lower thread surfaces in said first region is in the range 1° to 7°.

36. A container closure assembly according to claim 22, wherein said second region is adjacent to said first region.

37. A container closure assembly according to claim 22, wherein said pitch of said lower thread surfaces in said second region is substantially constant and said second region extends for 15–35° about a circumference of one of said container neck and said closure skirt.

38. A container closure assembly according to claim 22, wherein said pitch of said lower thread surfaces in said second region is in the range 15° to 35°.

39. A container closure assembly according to claim 1, further comprising a transverse gas venting channel extending through one or more of said second thread segments.

40. A container closure assembly according to claim 39, wherein said transverse gas venting channel has a tapered cross-section.

41. A container closure assembly according to claim 1, further comprising an axial gas venting channel extending through one or more of said second thread segments.

* * * * *

UNITED STATES PATENT AND TRADEMARK OFFICE

CERTIFICATE OF CORRECTION

PATENT NO. : 6,227,391 B1
DATED : May 8, 2001
INVENTOR(S) : Roger Milner King

It is certified that error appears in the above-identified patent and that said Letters Patent is hereby corrected as shown below:

Claim 1,
Line 1, immediately after "comprising" delete ";" (semicolon) and substitute -- : -- colon in its place.

Claim 19,
Line 7, delete "engage" and substitute -- engaged -- in its place.

Signed and Sealed this

Twenty-sixth Day of March, 2002

*Attest:*

*Attesting Officer*

JAMES E. ROGAN
*Director of the United States Patent and Trademark Office*